US009565975B1

(12) United States Patent
Amato et al.

(10) Patent No.: US 9,565,975 B1
(45) Date of Patent: Feb. 14, 2017

(54) INFANT AND TODDLER BATHTUB CHAIR

(71) Applicants: Shirley Amato, Grove City, OH (US); Charles Amato, Grove City, OH (US)

(72) Inventors: Shirley Amato, Grove City, OH (US); Charles Amato, Grove City, OH (US)

( * ) Notice: Subject to any disclaimer, the term of this patent is extended or adjusted under 35 U.S.C. 154(b) by 249 days.

(21) Appl. No.: 14/162,358

(22) Filed: Jan. 23, 2014

Related U.S. Application Data

(60) Provisional application No. 61/832,320, filed on Jun. 7, 2013.

(51) Int. Cl.
*A47K 3/12* (2006.01)

(52) U.S. Cl.
CPC ..... *A47K 3/127* (2013.01)

(58) Field of Classification Search
CPC ..... A47K 3/12; A47K 3/122; A47K 3/125; A47K 3/127; A47C 3/36; A47C 3/34; A47C 3/20; B60N 2/163
USPC ..... 297/448.1, 452.17, 297, 302.1, 423.34,297/423.38
See application file for complete search history.

(56) References Cited

U.S. PATENT DOCUMENTS 2,193,374 A 3/1940 Notter
2,985,889 A * 5/1961 Fain et al. ..... 4/575.1
3,633,222 A * 1/1972 Greenfield ..... 4/517
4,216,552 A 8/1980 Gurolnick
4,359,245 A * 11/1982 Franke ..... 297/284.1
4,516,282 A * 5/1985 Topalian et al. ..... 5/603
D289,319 S 4/1987 Kujawski et al.
4,837,871 A 6/1989 Wheeler
D318,112 S 7/1991 Jacques
5,092,001 A 3/1992 Ross et al.
5,297,300 A * 3/1994 Sheu ..... 4/572.1
5,599,063 A * 2/1997 Lister et al. ..... 297/325
D386,318 S 11/1997 Smith
7,673,940 B2 * 3/2010 Fritz ..... A47D 1/004 297/250.1
D648,551 S * 11/2011 Clark ..... D6/361
2005/0138724 A1 * 6/2005 Owen ..... 4/574.1
2009/0031490 A1 2/2009 Kassai et al.

* cited by examiner

*Primary Examiner* — Janie Loeppke
(74) *Attorney, Agent, or Firm* — Robert C. Montgomery; Montgomery Patent & Design LP.

(57) ABSTRACT

A bathtub chair is a planar support having a base rising upward to a first crest, extending downward therefrom to a though, rising upward therefrom to a second crest, and extending downward to a foot. The front base and rear foot are provided with a non-skid surface. An upper surface of the chair is provided with a non-skid cushion. An adjustment mechanism in the rear support base can be utilized to modify the tilt angle of the chair. The lower curve supports an occupant's legs and the larger curve supports the occupant's back and head. Maintaining the child's position minimizes water and soap flowing onto the child's face and eyes during washing.

13 Claims, 4 Drawing Sheets

INFANT AND TODDLER BATHTUB CHAIR

RELATED APPLICATIONS

The present invention was first described in and claims the benefit of U.S. Provisional Application No. 61/832,320, filed Jun. 7, 2013, the entire disclosures of which are incorporated herein by reference.

FIELD OF THE INVENTION

The present invention describes a bathtub chair to support an infant or a toddler in a salutary up-right position while inside a bathtub and receiving a bath.

BACKGROUND OF THE INVENTION

The act of washing a child's hair in a bathtub is hectic for both the child and care giver. Many children have a fear of shampoo getting in their eyes which causes an undo amount of movement on their part. This causes the care giver to mildly restrain the child for their safety, but this makes the act of washing the child's hair even more difficult. Additionally, the bathtub is hardly known for its comfort. After all, it is basically nothing more than a box, made of hard material, and filled with water. If the child wishes to recline in a standard tub, they must rest their head on an edge, and let their back and spine hang unsupported. Children who are in this environment are also known to slip and slide about, perhaps falling down, or hitting their head. At the very least, a parent or care giver who tries to shampoo the child's hair is almost guaranteed to get as wet as the child. Accordingly, there exists a need for a means by which a child's hair can be shampooed in a bathtub, while providing greater comfort and safety for both the child and the care giver.

SUMMARY OF THE INVENTION

The disadvantages of the prior art are overcome by the present invention in which a child's chair for use in the bathtub is provided. The child's chair comprises a first curved planar member, having a shape defined as starting from a base rising upward to a first crest, extending downward therefrom to a though, rising upward therefrom to a second crest, and extending downward to a foot. A second curved planar member is disposed upon and affixed of the first curved planar member. A height adjustment assembly is also provided to adjust the height of the second crest with respect to the first crest. A support foot is located on a bottom surface of the trough to support the weight of the chair and the child. A cushioned pad is affixed to the top surface of the second curved planar member to provide a soft surface that is non-slip. The base and the foot also incorporate a non-slip gripping surface to prevent movement of the chair in the bathtub.

In this manner, the present invention overcomes the disadvantages of the prior art and provides a safe and secure means to bath an infant and/or a toddler in an adult full sized bathtub.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
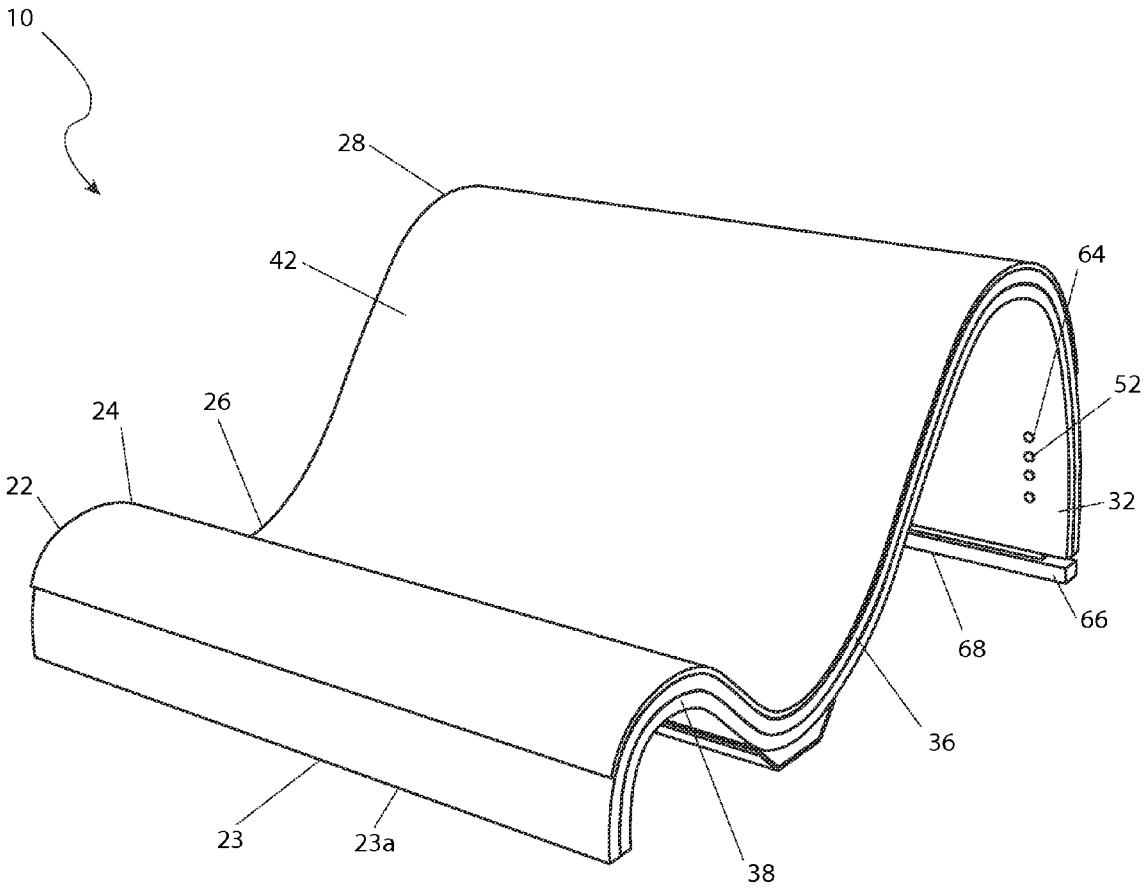
FIG. 1 is an isometric view of the front of a bathtub chair 10 in accordance with the preferred embodiment of the present invention.

10 bathtub chair
22 front support
23 base
23*a* base grip
24 small curve
26 trough
28 large curve
32 rear support
36 upper shell
38 lower shell
42 cushion
44 support foot
48 cavity
50 adjustment assembly
52 adjustment aperture
62 adjustment bar
64 pin
66 foot
68 foot grip
76 column
78 column aperture
100 occupant
105 support surface

DETAILED DESCRIPTION OF THE PREFERRED EMBODIMENT

In accordance with the invention, the best mode is presented in terms of a preferred embodiment, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Figure 2:
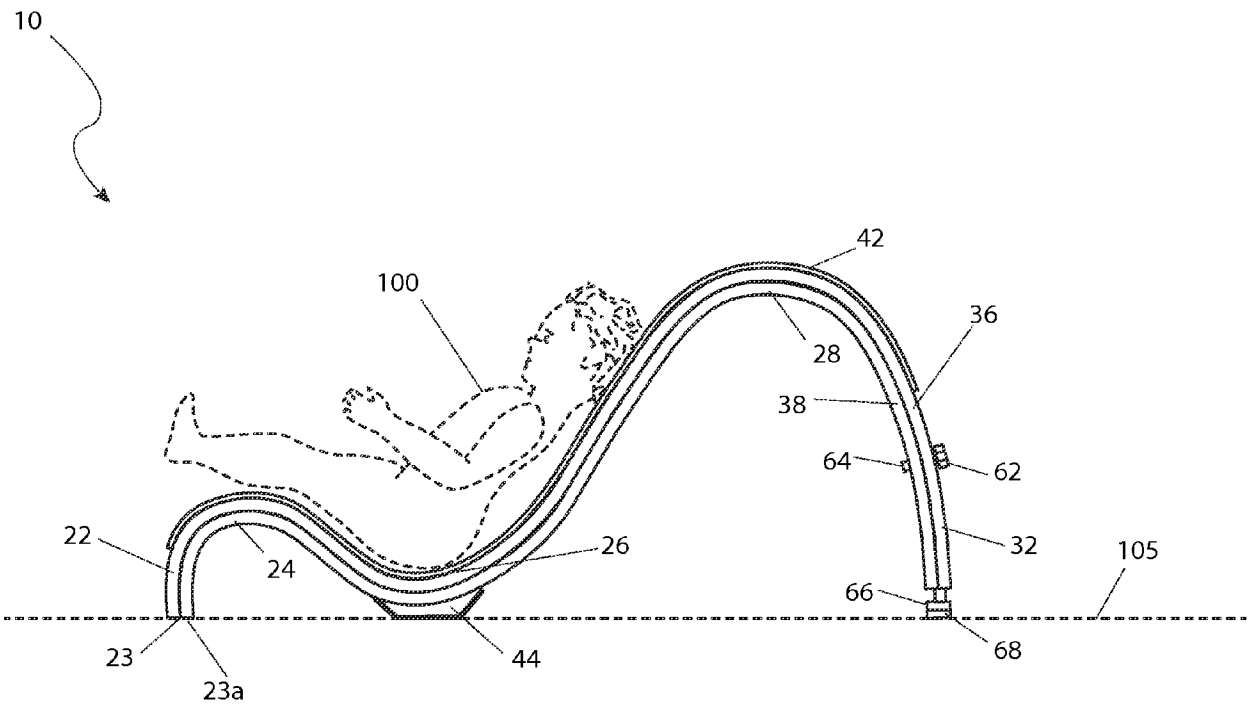
FIG. 2 is a side elevation view of the bathtub chair 10 with an occupant 100 in accordance with the preferred embodiment of the present invention.

Referring now to FIG. 1, an isometric view, and FIG. 2, a side elevation view, of the apparatus 10, according to the preferred embodiment of the present invention, are disclosed. The apparatus 10 preferably comprises a thermoplastic material and constructed from a plurality of injection-molded parts and as such may be presented in a wide variety of colors and surface finish textures to form a planar support having an upper shell 36, a lower shell 38, and an adjustment assembly 50 (see FIG. 4) formed in a general double "S" shape. The upper shell 36 and the lower shell 38 are conjoined after formation and incorporate the details a front support 22 that rises upward from a base 23 to a crest, defined herein as a contoured small curve 24, falls to a trough 26, rises again upward into a higher crest, defined herein as a contoured large curve 28, and falls to a rear support 32 and foot 66.

The front support 22 distributes a portion of the weight of the apparatus 10 and the occupant 100 onto a support surface 105. The convex small curve 24, as well as the transition between the small curve 24 and the trough 26, supports the feet and the legs of the occupant 100. The majority of the occupant's weight is supported in the concave trough 26. The transition from the trough 26 to the convex large curve 28 will support the back and head of the occupant 100. A larger occupant 100 will be seated in the trough 26 and extend farther up the large curve 28 as well as farther onto, or over, the small curve 24. The upper shell 36 and the lower shell 38 are formed with a uniform thickness except for the rear support 32 segment which will have an abrupt change in thickness along a portion of the height and width of said rear support 32 segment such that a cavity 48 (see FIG. 4) will be formed. This cavity 48 (see FIG. 4) may be a unitary void or comprised of a plurality of alternate voids and full thickness sections evenly spaced along the rear support 32 segment. Disposed upon the rear support 32 segment of both the upper shell 36 and the lower shell 38 is a plurality of adjustment apertures 52 oriented in a number of sets. The diameter of the adjustment apertures 52 would be in keeping with a sliding fit with the pins 64 (see FIG. 4) of an adjustment bar 62 (see FIG. 4).

Disposed upon the upper surface of the upper shell 36, extending from the front support 22 through the large curve 28, is a cushion 42 comprised preferably of a layer of closed-cell foam attached to the upper surface with a layer of adhesive. Disposed upon the lower shell 38 in the area of the trough 26 is a support foot 44, which greatly increases the structural rigidity of the trough 26 and in some situations may contact the support surface 105. The lower edge of the front support 22 provides the base 23. The base 23 may include a non-skid grip 23*a*, which is comprised preferably of rubber, or a rubber-like material.

Figure 3:
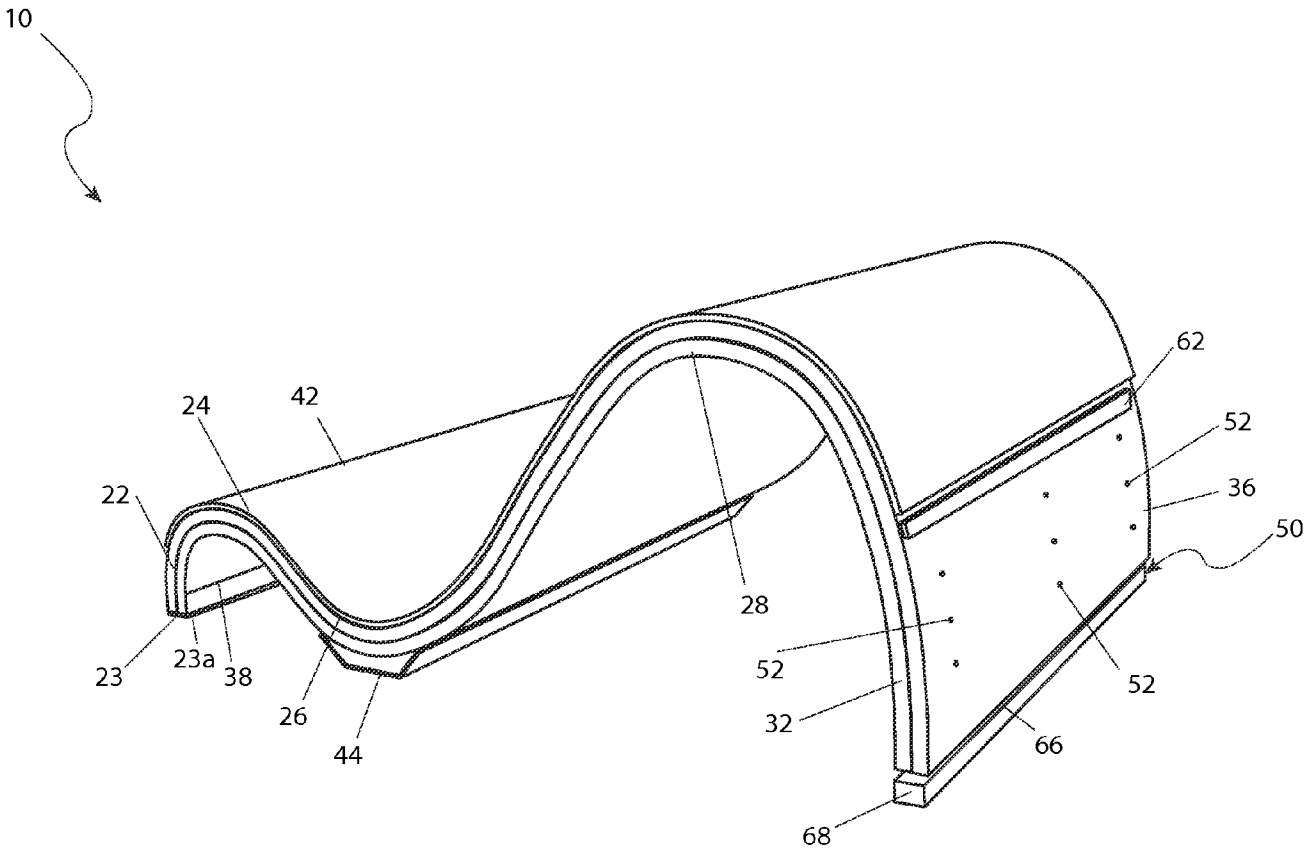
FIG. 3 is an isometric view of the bathtub chair 10 depicted with an adjustment assembly 50 in an up position in accordance with the preferred embodiment of the present invention; and, FIG. 4 is an isometric view of the bathtub chair 10 depicted with the adjustment assembly 50 in a down position and a break-away view of cavity 48 in accordance with the preferred embodiment of the present invention.
Figure 4:
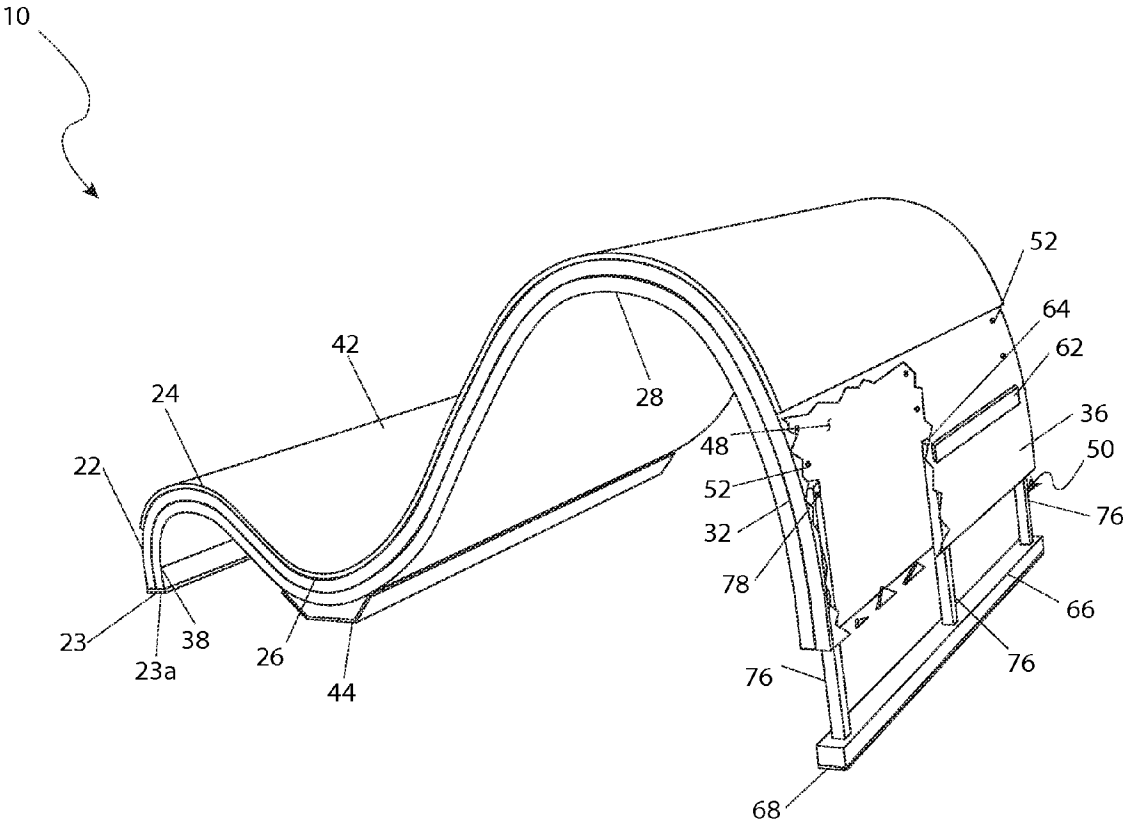

Referring now to FIGS. 3 and 4, isometric views of the apparatus 10, according to the preferred embodiment of the present invention, are disclosed. The apparatus 10 is provided with a height adjustment assembly 50, which incrementally modifies the relative position of some segments of the apparatus 10 with the support surface 105 (see FIG. 2). The adjustment assembly is generally comprised of a foot 66 provided with a plurality of evenly spaced columns 76, and the adjustment bar 62 provided with a plurality of evenly spaced pins 64. The foot 66 is preferably a rectangular bar approximately equal in length to the width of the apparatus 10. The columns 76 are square, or rectangular, bars approximately six inches (6 in.) in length and preferably formed with a first end attached to the foot 66. A foot grip 68 is preferably comprised of rubber, or a rubber-like material, is attached to the side of the foot 66 opposite from the columns 76 with a layer of adhesive, or some other means. Each of the columns 76 is provided with a column aperture 78 at, or near, a second end of said column 76. The diameter of the column aperture 78 would be in keeping with the diameter of the adjustment apertures 52.

The adjustment bar 62 is preferably comprised of a thermoplastic material and formed with a plurality of evenly spaced cylindrical pins 64. The free ends of the pins 64 are inserted into a set of adjustment apertures 52 aligned with the column apertures 78 in order to maintain the position of the adjustment assembly 50.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the enabled user in a simple and straightforward manner with little or no training. After initial purchase or acquisition of the apparatus 10, it would be installed as indicated in FIGS. 1 and 4.

The method of utilizing the apparatus 10 may be achieved by performing the following steps: acquiring a model of the apparatus 10 having a desired style to suit the user's taste; adjusting the apparatus to accommodate the present occupant by removing the adjustment bar 62 with conjoined pins 64 from the currently aligned adjustment apertures 52 and column apertures 78; moving the adjustment assembly 50 within the cavity 48 to bring about the realignment of the column apertures 78 with another set of adjustment apertures 52 in the rear support 32 corresponding to the appropriate adjustment of the apparatus 10 relative to the support surface 105; reinstalling the pins 64 with the conjoined adjustment bar 62 into the desired set of aligned apertures 52, 78; placing the apparatus 10 into the bathing area with the base grip 23 and the foot grip 68 in contact with the support surface 105; placing the occupant's 100 buttocks into the trough 26 with the occupant's 100 legs and feet supported on the small curve 24 and the occupant's 100 back supported on the transition from the said trough 26 and the large curve 28; and cleansing the occupant 100. into the appropriate receptacle; and, cleaning the apparatus 10.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A chair comprising:

a first curved shell having a shape defined as starting from a base rising upward to a first crest, extending downward therefrom to a trough, rising upward therefrom to a second crest, and extending downward to a first shell bottom;

a second curved shell disposed upon and affixed to said first curved shell, said second curved shell having a shape defined as starting from said base rising upward to said first crest, extending downward therefrom to said trough, rising upward therefrom to said second crest, and extending downward to a second shell bottom adjacent said first shell bottom, wherein said second curved shell includes a hollow extending from said second shell bottom towards said second crest;

a cushioned pad affixed to said second curved shell; and, a height adjustment assembly including an assembly foot below said second shell bottom and extending into said hollow for adjusting the height of said second crest with respect to said first crest, further comprising:

an elongated horizontal bar in said hollow;

a first vertical column affixed to said horizontal bar within said hollow and extending from said horizontal bar to said assembly foot;

a first plurality of apertures on a surface of said second curved shell and a second plurality of apertures on said first vertical column; and, a pin adapted to be slidably inserted into an aperture of said first plurality of apertures to engage one of said second plurality of apertures, thereby selectively setting the height of said chair.

2. The chair of claim 1, wherein said second crest is higher than said first crest.

3. The chair of claim 2, further comprising a support foot located on said first curved shell at said trough.

4. The chair of claim 1, further comprising a non-slip grip affixed to said base.

5. The chair of claim 4, further comprising a non-slip grip affixed to said foot.

6. The chair of claim 1, wherein said second curved shell further comprises a third plurality of apertures and said height adjustment assembly further comprises a second vertical column affixed to said horizontal bar within said hollow and extending from said horizontal bar to said assembly foot, said second vertical column having a fourth plurality of apertures such that said third and fourth plurality of apertures are in vertical alignment.

7. The chair of claim 1, wherein said first and said second curved shells are formed of a material that is non-reactive to water submersion.

8. A chair comprising:

a first curved shell having a shape defined as starting from a base rising upward to a first crest, extending downward therefrom to a trough, rising upward therefrom to a second crest, and extending downward to a first shell bottom;

a second curved shell disposed upon and affixed to said first curved shell, said second curved shell having a shape defined as starting from said base rising upward to said first crest, extending downward therefrom to said trough, rising upward therefrom to said second crest, and extending downward to a second shell bottom adjacent said first shell bottom, wherein said second shell includes a hollow extending from said second shell bottom towards said second crest;

a cushioned pad affixed to said second curved shell; and, a height adjustment assembly to adjust the height of said second crest with respect to said first crest comprising:

an elongated horizontal bar below said second shell bottom;

a first vertical column extending from said horizontal bar into said hollow;

a first plurality of apertures on a surface of said second curved shell and a second plurality of apertures on said first vertical column, said first and said second plurality of apertures in vertical alignment with each other; and, a first pin adapted to be slidably inserted into an aperture of said first plurality of apertures to engage one of said second plurality of apertures thereby selectively setting the height of said chair.

9. The chair of claim 8, wherein said second crest is higher than said first crest.

10. The chair of claim 9, further comprising a support foot located on a bottom surface of said trough.

11. The chair of claim 8, further comprising a non-slip grip affixed to said base.

12. The chair of claim 8, further comprising a non-slip grip affixed to said horizontal bar.

13. The chair of claim 8, wherein said first and said second shells are formed of a material that is non-reactive to water submersion.

* * * * *